US007178745B1

(12) United States Patent
Fugere

(10) Patent No.: US 7,178,745 B1
(45) Date of Patent: Feb. 20, 2007

(54) DISPENSE TIP WITH VENTED OUTLETS

(75) Inventor: Jeffrey P. Fugere, Sandown, NH (US)

(73) Assignee: DL Technology, LLC, Haverhill, MA (US)

( * ) Notice: Subject to any disclaimer, the term of this patent is extended or adjusted under 35 U.S.C. 154(b) by 138 days.

(21) Appl. No.: 11/082,539

(22) Filed: Mar. 17, 2005

Related U.S. Application Data

(60) Division of application No. 10/038,381, filed on Jan. 4, 2002, now Pat. No. 6,957,783, which is a continuation-in-part of application No. 09/702,522, filed on Oct. 31, 2000, now Pat. No. 6,511,301, and a continuation-in-part of application No. 09/491,615, filed on Jan. 26, 2000, now Pat. No. 6,547,167.

(60) Provisional application No. 60/259,730, filed on Jan. 4, 2001, provisional application No. 60/186,763, filed on Mar. 3, 2000, provisional application No. 60/163,952, filed on Nov. 8, 1999, provisional application No. 60/163,938, filed on Nov. 8, 1999, provisional application No. 60/117,201, filed on Jan. 26, 1999.

(51) Int. Cl.

| | |
|---|---|
| ***A62C 31/00*** | (2006.01) |
| ***B05B 1/26*** | (2006.01) |
| ***B05B 1/34*** | (2006.01) |
| ***B05B 11/02*** | (2006.01) |

(52) U.S. Cl. ..... 239/436; 239/461; 239/468; 239/480; 239/481; 239/302; 239/324; 239/333; 239/349

(58) Field of Classification Search ..... 239/463, 239/461, 468, 476, 480, 481, 302, 324, 337, 239/333, 349
See application file for complete search history.

(56) References Cited

U.S. PATENT DOCUMENTS

| | | | |
|---|---|---|---|
| 2,933,256 | A | 4/1960 | Raskin |
| 3,355,766 | A | 12/1967 | Causemann |
| 3,394,659 | A | 7/1968 | Van Alen |
| 3,507,584 | A | 4/1970 | Robbins, Jr. |

(Continued)

FOREIGN PATENT DOCUMENTS

| | | |
|---|---|---|
| EP | 0110591 | 10/1986 |

OTHER PUBLICATIONS

Karassik, et al, "Pump Hand Book" Second Ed., McGraw Hill Inc., 1986, p. 9.30.

(Continued)

*Primary Examiner*—Davis Hwu
(74) *Attorney, Agent, or Firm*—Mills & Onello LLP

(57) ABSTRACT

In a fluid pump and cartridge assembly, a cartridge includes a material inlet port, a material outlet port, and a feed screw. The feed screw delivers fluid to be dispensed from the fluid inlet to the outlet port. The fluid inlet is preferably elongated in a direction along a longitudinal axis of the feed screw to enhance consistency in material flow through the cartridge. The feed screw is preferably driven by a closed-loop servo motor to achieve high-performance dispensing resolution. The assembly is preferably compatible with fixed-z and floating-z cartridges. A optional vented dispense tip, in combination with the fluid pump, allows for repeatable deposit of fillet patterns while maintaining optimal consistency.

34 Claims, 10 Drawing Sheets

U.S. PATENT DOCUMENTS 3,693,884 A 9/1972 Snodgrass et al. ..... 239/427.5
3,734,635 A 5/1973 Blach et al. ..... 415/72
3,811,601 A 5/1974 Reighard et al.
3,938,492 A 2/1976 Mercer, Jr. ..... 125/11 R
3,963,151 A 6/1976 North, Jr. ..... 222/309
4,004,715 A 1/1977 Williams et al. ..... 222/30
4,077,180 A 3/1978 Agent et al. ..... 53/37
4,116,766 A 9/1978 Poindexter et al. ..... 176/38
4,168,942 A 9/1979 Firth
4,239,462 A 12/1980 Dach et al.
4,258,862 A 3/1981 Thorsheim ..... 222/56
4,312,630 A 1/1982 Travaglini
4,339,840 A 7/1982 Monson ..... 15/321
4,377,894 A 3/1983 Yoshida
4,386,483 A 6/1983 Schlaefi ..... 51/5
4,408,699 A 10/1983 Stock
4,513,190 A 4/1985 Ellett et al. ..... 219/56.21
4,572,103 A 2/1986 Engel
4,584,964 A 4/1986 Engel
4,610,377 A 9/1986 Rasmussen ..... 222/288
4,705,218 A 11/1987 Daniels ..... 239/271
4,705,611 A 11/1987 Grimes et al. ..... 204/129.1
4,785,996 A 11/1988 Ziecker et al.
4,803,124 A 2/1989 Kunz
4,836,422 A 6/1989 Rosenberg ..... 222/190
4,859,073 A 8/1989 Howseman, Jr. et al.
4,917,274 A 4/1990 Asa et al.
4,919,204 A 4/1990 Baker et al. ..... 166/223
4,941,428 A 7/1990 Engel
4,969,602 A 11/1990 Scholl
5,002,228 A * 3/1991 Su ..... 239/333
5,106,291 A 4/1992 Gellert
5,130,710 A 7/1992 Salazar ..... 341/11
5,161,427 A 11/1992 Fukuda et al.
5,176,803 A 1/1993 Barbuto et al. ..... 204/129.1
5,177,901 A 1/1993 Smith ..... 51/5 D
RE34,197 E 3/1993 Engel ..... 118/680
5,265,773 A 11/1993 Harada ..... 222/261
5,348,453 A 9/1994 Baran et al. ..... 417/440
5,407,101 A 4/1995 Hubbard
5,452,824 A 9/1995 Danek et al.
5,535,919 A 7/1996 Ganzer et al.
5,553,742 A 9/1996 Maruyama et al.
5,564,606 A 10/1996 Engel
5,567,300 A 10/1996 Datta et al.
5,699,934 A 12/1997 Kolcun et al. ..... 222/1
5,765,730 A 6/1998 Richter ..... 222/590
5,785,068 A 7/1998 Sasaki et al. ..... 134/144
5,795,390 A 8/1998 Cavallaro ..... 118/314
5,803,661 A * 9/1998 Lemelson ..... 404/75
5,819,983 A 10/1998 White et al.
5,823,747 A 10/1998 Ciavarini et al. ..... 417/214
5,833,851 A 11/1998 Adams et al.
5,837,892 A 11/1998 Cavallaro et al. ..... 73/149
5,886,494 A 3/1999 Prentice et al. ..... 318/625
5,903,125 A 5/1999 Prentice et al. ..... 318/625
5,904,377 A 5/1999 Throup ..... 285/39
5,918,648 A 7/1999 Carr et al. ..... 141/198
5,925,187 A 7/1999 Freeman et al. ..... 118/667
5,927,560 A 7/1999 Lewis et al. ..... 222/263
5,931,355 A 8/1999 Jefferson ..... 222/413
5,947,022 A 9/1999 Freeman et al. ..... 101/123
5,947,509 A 9/1999 Ricks et al.
5,957,343 A 9/1999 Cavallaro ..... 222/504
5,971,227 A 10/1999 White et al. ..... 222/333
5,984,147 A 11/1999 Van Ngo
5,985,029 A 11/1999 Purcell ..... 118/324
5,985,216 A 11/1999 Rens et al. ..... 442/73
5,992,688 A 11/1999 Lewis et al. ..... 222/1
5,992,698 A 11/1999 Copeland et al.
5,995,788 A 11/1999 Back
6,007,631 A 12/1999 Prentice et al. ..... 118/669
6,017,392 A 1/2000 Cavallaro ..... 118/314
6,025,689 A 2/2000 Prentice et al. ..... 318/625
6,068,202 A 5/2000 Hynes et al. ..... 239/290
6,082,289 A 7/2000 Cavallaro ..... 118/300
6,085,943 A 7/2000 Cavallaro et al.
6,093,251 A 7/2000 Carr et al. ..... 118/712
6,112,588 A 9/2000 Cavallaro et al. ..... 73/149
6,119,895 A 9/2000 Fugere et al. ..... 222/1
6,126,039 A 10/2000 Cline et al. ..... 222/63
6,157,157 A 12/2000 Prentice et al. ..... 318/625
6,196,521 B1 3/2001 Hynes et al. ..... 251/61.1
6,199,566 B1 3/2001 Gazewood ..... 134/166 C
6,206,964 B1 3/2001 Purcell et al. ..... 118/314
6,207,220 B1 3/2001 Doyle et al. ..... 427/96
6,214,117 B1 4/2001 Prentice et al. ..... 118/669
6,216,917 B1 4/2001 Prentice et al. ..... 222/146.5
6,224,671 B1 5/2001 Cavallaro ..... 118/314
6,224,675 B1 5/2001 Prentice et al. ..... 118/669
6,234,358 B1 5/2001 Romine et al.
6,253,957 B1 7/2001 Messerly et al.
6,253,972 B1 7/2001 DeVito et al. ..... 222/504
6,257,444 B1 7/2001 Everett
6,258,165 B1 7/2001 Cavallaro ..... 118/323
6,322,854 B1 11/2001 Purcell et al. ..... 427/421
6,324,973 B2 12/2001 Rossmeisl et al. ..... 101/123
6,354,471 B2 3/2002 Fujii
6,371,339 B1 4/2002 White et al. ..... 222/413
6,378,737 B1 4/2002 Cavallaro et al. ..... 222/309
6,383,292 B1 5/2002 Brand et al. ..... 118/315
6,386,396 B1 5/2002 Strecker ..... 222/261
6,391,378 B1 5/2002 Carr et al. ..... 427/8
6,395,334 B1 5/2002 Prentice et al. ..... 427/256
6,412,328 B1 7/2002 Cavallaro et al. ..... 73/1.74
6,453,810 B1 9/2002 Rossmeisl et al. ..... 101/123
6,511,301 B1 1/2003 Fugere ..... 417/359
6,514,569 B1 2/2003 Crouch ..... 427/421
6,540,832 B2 4/2003 Cavallaro ..... 118/314
6,541,063 B1 4/2003 Prentice et al. ..... 427/8
6,562,406 B1 5/2003 Chikahisa et al. ..... 427/256
6,619,198 B2 9/2003 Rossmeisl et al. ..... 101/129
6,626,097 B2 9/2003 Rossmeisl et al. ..... 101/123
2002/0007227 A1 1/2002 Prentice et al. ..... 700/121
2002/0020350 A1 2/2002 Prentice et al. ..... 118/669
2003/0000462 A1 1/2003 Prentice et al.
2003/0066546 A1 4/2003 Bibeault et al. ..... 134/21
2003/0084845 A1 5/2003 Prentice et al. ..... 118/679
2003/0091727 A1 5/2003 Prentice et al. ..... 427/8
2003/0132243 A1 7/2003 Engel ..... 222/61
2004/0089228 A1 5/2004 Prentice et al.

OTHER PUBLICATIONS

Micro-Mechanics Design Specifications, May 1999.
Ulrich, Rene, "Epoxy Die Attach: The Challenge of Big Chips", Semiconductor International Oct. 1994.
Sela, Uri, et al., "Dispensing Technology: The Key to High-Quality, High-Speed, Die-Bonding", Microelectronics Manufacturing Technology, Feb. 1991.

* cited by examiner

DISPENSE TIP WITH VENTED OUTLETS

RELATED APPLICATIONS

This application is a Divisional of U.S. patent application Ser. No. 10/038,381, filed Jan. 4, 2002; now U.S. Pat. No. 6,957,783 which is a Continuation-in-Part of U.S. patent application Ser. No. 09/702,522, filed Oct. 31, 2000, now U.S. Pat. No. 6,511,301, which claims the benefit of U.S. Provisional Application No. 60/186,763, filed Mar. 3, 2000 and U.S. Provisional Application No. 60/163,952, filed Nov. 8, 1999, which is also a Continuation-in-Part of U.S. patent application Ser. No. 09/491,615, filed Jan. 26, 2000, now U.S. Pat. No. 6,547,167, which claims the benefit of U.S. Provisional Application No. 60/117,201, filed Jan. 26, 1999, and U.S. Provisional Application No. 60/163,938, filed Nov. 8, 1999, and which claims the benefit of U.S. Provisional Application No. 60/259,730, filed Jan. 4, 2001, the contents each of which are each incorporated herein by reference, in their entirety.

BACKGROUND OF THE INVENTION

Contemporary fluid dispense systems are well suited for dispensing precise amounts of fluid at precise positions on a substrate. A pump transports the fluid to a dispense tip, also referred to as a "pin" or "needle", which is positioned over the substrate by a micropositioner, thereby providing patterns of fluid on the substrate as needed. As an example application, fluid delivery systems can be utilized for depositing precise volumes of adhesives, for example, glue, resin, or paste, during a circuit board assembly process, in the form of dots for high-speed applications, or in the form of lines for providing underfill or encapsulation.

Contemporary dispensing pumps comprise a syringe, a feed tube, a dispense cartridge, and pump drive mechanism. The syringe contains fluid for dispensing, and has an opening at its distal end at which a feed tube is connected. The feed tube is a flexible, hollow tube for delivering the fluid to the cartridge. The cartridge is hollow and cylindrical and includes an inlet neck at which the opposite end of the feed tube is connected. The inlet neck directs the fluid into the hollow, central cartridge chamber.

A feed screw disposed longitudinally through the center of the cylindrical chamber transports the fluid in Archimedes principle fashion from the inlet to a dispensing needle attached to the chamber outlet. A continuously-running motor drives the feed screw via a rotary clutch, which is selectively actuated to engage the feed screw and thereby effect dispensing. A bellows linkage between the motor and cartridge allows for flexibility in system alignment.

Pump systems can be characterized generally as "fixed-z" or "floating-z" (floating-z is also referred to as "compliant-z"). Fixed-z systems are adapted for applications that do not require contact between the dispense tip and the substrate during dispensing. In fixed-z applications, the dispense tip is positioned and suspended above the substrate by a predetermined distance, and the fluid is dropped onto the substrate from above. In floating-z applications, the tip is provided with a standoff, or "foot", designed to contact the substrate as fluid is delivered by the pump through the tip. Such floating-z systems allow for tip travel, relative to the pump body, such that the entire weight of the pump does not bear down on the substrate.

Such conventional pump systems suffer from several limitations. The motor and rotary clutch mechanisms are bulky and heavy, and are therefore limited in application for modern dispensing applications requiring increasingly precise, efficient, and fast operation. The excessive weight limits use for those applications that require contact of the pump with the substrate, and limits system speed and accuracy, attributed to the high g-forces required for quick movement of the system. The mechanical clutch is difficult to control, and coasts to a stop when disengaged, resulting in deposit of excess fluid. Clutch coasting can be mitigated by a longitudinal spring mounted about the body of the feed screw and urged against the chamber end to offer rotational resistance. However, the spring adds to the length of the cartridge, and contributes to system complexity.

The inlet neck feeds directly into the side of the feed screw or "auger". Consequently, as the auger collects material from the small and circular inlet port, high pressure is required for driving the material into the auger body, because the auger threads periodically pass in front of the feed opening, preventing material from entering. This leads to inconsistent material flow. Additionally, the inlet neck is commonly perpendicular to the auger screw, requiring the fluid to make a 90 degree turn upon entering the pump. This further limits material flow and can contribute to material "balling" and clogging.

Overnight storage of dispensed fluids often requires refrigeration of the fluid and cleaning of the system. The syringe is typically mounted directly to a mounting bracket on the pump body such that the output port of the syringe passes through an aperture on the mounting bracket. The feed tube is then coupled to the output port on the opposite face of the bracket. Since the tube and bracket are on opposite sides of the bracket, removal of the syringe from the pump body requires dismantling of the tube and syringe, which can contaminate fluid material positioned at the interface during disassembly. Further, since the syringe and cartridge can not be removed and stored together as a unit, disassembly and cleaning of the cartridge is required. Additionally, the inlet neck is narrow and therefore difficult to clean.

SUMMARY OF THE INVENTION

The present invention is directed to a fluid pump and cartridge system that overcomes the limitations of conventional systems set forth above.

In a first aspect, the present invention is directed to a cartridge adapted for use with a fluid pump. The cartridge includes a material inlet port, a material outlet port, a feed screw, and a reservoir. The feed screw is disposed longitudinally through the body of the cartridge for delivering fluid provided at the inlet port to the outlet port. The inlet port takes the form of an elongated port provided at a side portion of the feed screw proximal to allow for fluid provided at the inlet port. This elongated configuration promotes even distribution of fluid during transport by the feed screw, and lowers system pressure, thereby reducing the likelihood of "balling-up" and/or clogging of fluid.

The inlet port is preferably provided through the cartridge body at an acute angle relative to the reservoir to allow for gravity-assisted fluid delivery. The inner portion of the cartridge may be lined with a carbide or plastic (for example Teflon, torlon, or tercite) liner having an aperture aligned with the inlet port to enhance ease of cleaning. The elongated port of the cartridge may be provided in a wall of the carbide liner.

In another aspect, the present invention is directed to a release bracket for mounting the syringe and cartridge to the body of the pump. In this manner, the syringe, feed tube, and cartridge can be dismantled from the pump body as a unit, allowing for joint storage of the syringe, feed tube and cartridge, while minimizing risk of contamination of the material. Additionally, once the system is initially purged of extraneous gas during initialization, the purged system can be stored as a unit without the need for re-initialization prior to its next use.

In another aspect, the present invention is directed to a fluid pump assembly that employs an electronically-operated servo-motor assembly. A closed-loop servo motor having a rotary encoder is adapted for controlling rotation and position of the feed screw with heightened accuracy, as compared to those of conventional clutch-driven assemblies. For example, in a preferred embodiment, a rotary encoder capable of 8192 counts in a 360 degree range may be employed to achieve dispensing resolution to a degree that is orders of magnitude greater than conventional systems. Servo-motor-based systems further confer the advantages of small, lightweight systems well-suited for high-performance operation. Electronic control allows for complete determination of the acceleration/deceleration of feed screw rotation, allowing for application-specific flow profiles. An orbital gear transmission unit may be provided between the motor and the pump feed screw for providing further accuracy in controlling the feed screw; for example a 7:1 reduction may be applied to provide 57,344 counts over a 360 degree range.

In another aspect, the present invention is directed to a pump assembly that is compatible with both floating-z and fixed-z cartridges and dispensing tips. A quick-release pin, which may be spring-biased, is provided on the side of the cartridge body to allow for removal/insertion of cartridges. A fixed-z cartridge includes a hole for receiving the quick-release pin in a fixed relationship. A floating-z cartridge includes a longitudinal groove to permit longitudinal travel of the pin in the groove, and thus allow for floating-z operation.

In another aspect, the present invention is directed to a quick-release mount assembly for mounting a pump to a dispensing frame. The pump body includes a tab feature on its surface for mating with a hole on a mounting plate attached to the dispensing frame. The mounting plate includes a lever for securing the tab when inserted. Guide features may be provided for aligning and guiding the pump body relative to the mounting plate.

In another aspect, the present invention is directed to an apparatus and method for drawing entrapped air from the material supply during a dispensing operation, thereby purging the system of entrapped air. A vacuum is drawn from the material supply, for example by a vacuum tube with needle inserted into a material feed tube, in a direction parallel to material flow through the feed tube. In this manner, air is withdrawn from the dispensed material, leading to an improvement in dispensing consistency, especially at small tolerances.

In another aspect, the present invention is directed to a vacuum purge configuration for removing air entrapped in the body of the cartridge during initialization of a dispensing operation. A first purge interface is placed on the end of the feed tube, and a vacuum is drawn, thereby purging the feed tube of entrapped gas. A second purge interface is then placed on the cartridge body outlet while the feed screw is rotated slowly until material presents itself at the outlet. A vacuum is drawn to eliminate entrapped gas from the cartridge. A third purge interface is then placed on the needle assembly and a vacuum is drawn to eliminate entrapped air from the needle body. Entrapped air is thus substantially removed from the feed tube, auger screw and dispensing needle. Normal dispensing can commence following removal of the purge interface.

In another aspect, the present invention is directed to a bellows means inserted at the piston end of, and replacing the piston of, a dispensing syringe. The bellows is pressurized from within and expands, thereby exerting pressure on the underlying material, forcing material flow. In this manner, material can be driven with minimal pressure, and with minimal air migration into the material, as compared to plunger-style drivers. In a preferred embodiment, the bellows comprises a latex film applied about the lip of the syringe top. The syringe top is preferably vented to allow for expansion of the bellows.

In another aspect, the present invention is directed to a pump cartridge having a material feed aperture that is elongated with respect to the primary axis of the feed screw. In this manner, a larger portion of the feed screw threads are exposed to the material supply, leading to improvement in dispensing consistency. In a preferred embodiment, a carbide cartridge liner is inserted in the cartridge cavity between the cartridge body and the feed screw, and the elongated aperture is provided in the body of the carbide insert to provide increased material supply exposure.

In another aspect, the present invention is directed to a cartridge adapted for coupling to a fluid pump. The cartridge comprises a body having a bore; a fluid inlet at a proximal end of the bore; a fluid outlet at a distal end of the bore; a feed screw for delivering fluid from the fluid inlet to the fluid outlet, the feed screw having a longitudinal axis, the fluid inlet being elongated in a direction along the longitudinal axis of the feed screw; and a dispense tip at the fluid outlet having a longitudinal fluid path, the dispense tip having outlet vents at an output end, the outlet vents extending radially from the fluid path.

In a preferred embodiment, the outlet vents each comprise a V-groove having first and second inner surfaces. The first and second inner surfaces of the V-groove preferably intersect at an angle ranging between 45 degrees and 135 degrees. The outlet vents may be treated by a finishing process that reduces surface tension, for example a nutmeg-chrome process. The output end of the dispense tip may includes a relieved outer surface or a beveled outer surface. In another aspect, the present invention is directed to a fluid dispensing pump comprising: a feed screw having a helical cavity defined between a major diameter and a minor diameter of a thread of the feed screw; a cartridge body having a cavity in communication with the feed screw for introduction of dispensing fluids into the helical cavity; a motor having indexed rotational positions for controlling rotational position of the feed screw during a dispensing operation; and a dispense tip at a fluid outlet of the helical cavity having a longitudinal fluid path, the dispense tip having outlet vents at an output end, the outlet vents extending radially from the fluid path.

In another aspect, the present invention is directed to a fluid dispensing tip comprising an elongated cylindrical neck; a cylindrical bore machined in the neck centered at the longitudinal axis, the cylindrical bore having a cylindrical input end at an input end of the neck and a cylindrical output end at an output end of the neck; said cylindrical input end of said bore having a first inner diameter and said cylindrical output end of said bore having a second inner diameter, the first inner diameter being greater than the second inner diameter; an inner taper machined in the bore between the cylindrical input end and the cylindrical output end for transitioning the inner surface of the bore from the first inner diameter to the second inner diameter, the inner taper being proximal to the output end of the neck; and outlet vents at the output end of the neck, the outlet vents extending radially from the fluid path.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1B:
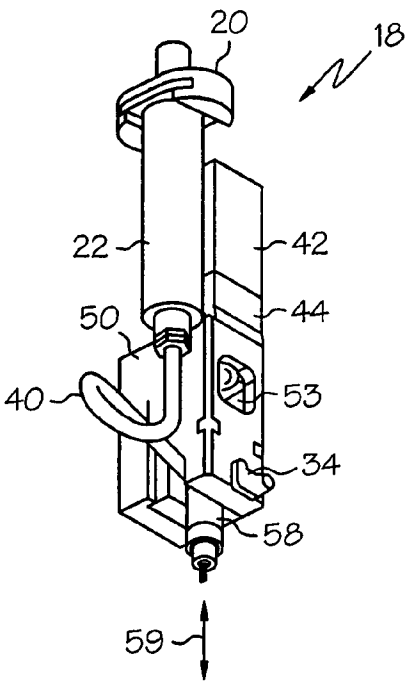
FIGS. 1A and 1B are an exploded perspective view and an assembled perspective view respectively of a pump assembly configured in accordance with the present invention.
Figure 1A:
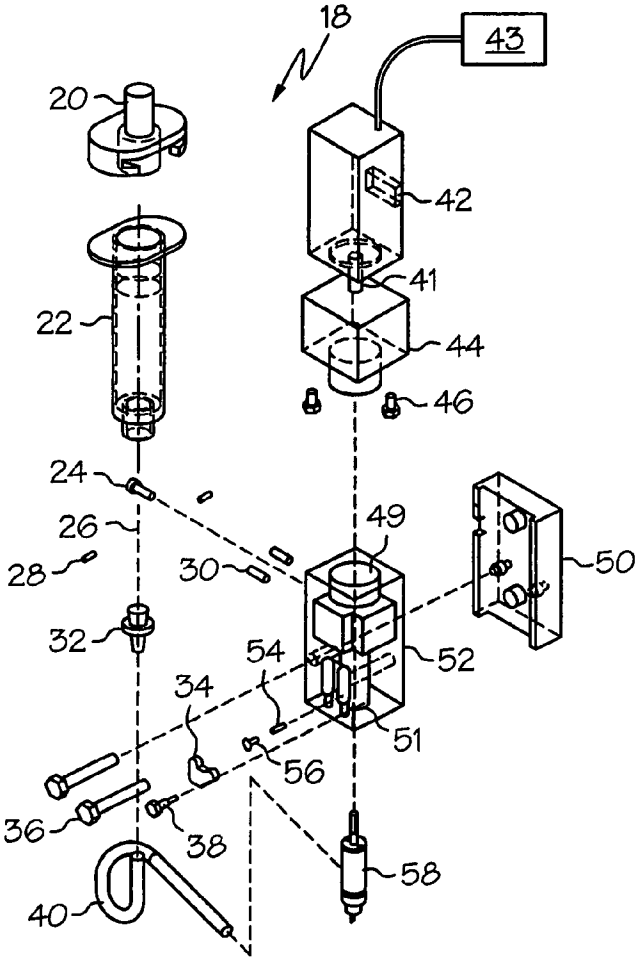

FIGS. 1A and 1B are an exploded perspective view and an assembled perspective view respectively of a pump assembly configured in accordance with the present invention. With reference to FIGS. 1A and 1B, an embodiment of the dispensing pump 18 comprises a motor 42, an optional transmission box 44, a pump housing 52, and a cartridge 58.

The motor 42 preferably comprises a closed-loop servo motor with an independent motion controller 43. The motion controller 43 may be provided by the host dispensing platform, and may comprise, for example, a Delta Tau controller, Northbridge, Calif., USA. The closed-loop servo motor may comprise, for example, a Sigma Mini Series motor, produced by Yaskawa Electric Corp., Japan. Feedback is preferably provided by a rotary encoder, for example providing 8192 discrete counts over 360 degree rotation. The motor 42 includes an axle 41 which operates to drive the feed screw in the cartridge assembly 58 (described below). In this manner, high-performance control is maintained over material dispensing. For example, rotary position, rotational velocity, and acceleration/deceleration of the feed screw can be readily controlled by the closed-loop servo motor, and is easily programmed at the controller 43. This is compared to conventional embodiments that rely on timed open-loop coasting of a mechanical clutch for control over the feed screw. Additionally, the closed-loop servo-motor is generally a compact system that is small, lightweight, and designed for high-performance operation; as compared to the bulky, inefficient, and inaccurate conventional motor pump systems.

An optional planetary-gear transmission box 44 may be provided to step down the available motor positions, thereby providing even more enhanced control over angular position of the feed screw. For example, step-down transmissions offering 7:1, 25:1, and 48:1 step-down ratios are available for increasing the number of angular steps from 8,192 to 57,344, 204,800 and 393,216 respectively, depending on the application. Such transmission boxes are also available in compact units that match well in size and weight with the closed-loop servo motor 42.

The pump housing 52 comprises a machined or die cast body having an opening 49 at a top portion for receiving the motor drive axle 41 or optional transmission box 44 drive axle (not shown). The interior of the housing 52 is hollow for receiving a cartridge 58 that extends through the housing 52 from an opening 51 at a bottom portion, upward to the top portion, and interfaces with the motor drive axle or transmission box drive axle. The motor 42 and transmission box 44 are mounted to each other, and to the housing 52, by bolts 46, and screws 24, 28, and 30. Cavities 53 are preferably provided in the walls of the housing 52, in order to reduce weight.

Figure 6B:
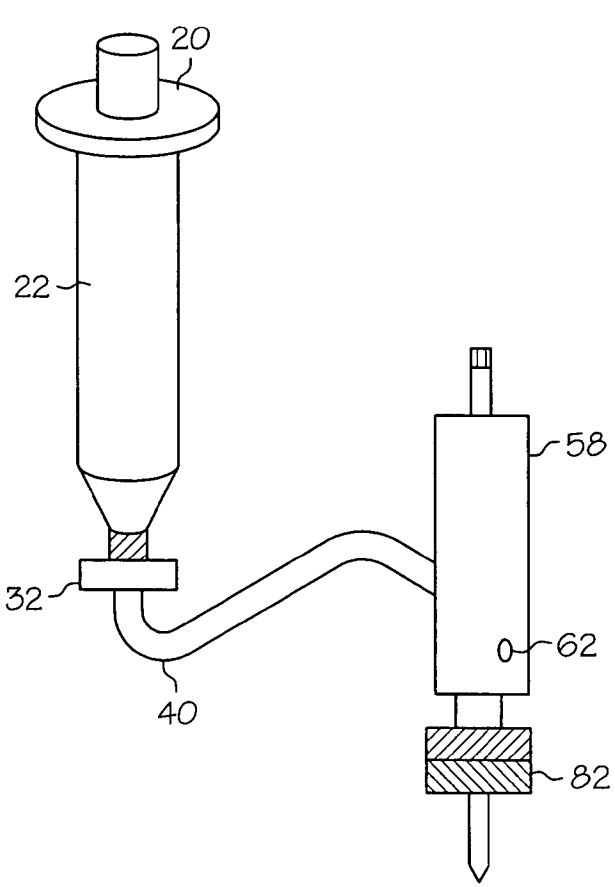
FIGS. 6A and 6B illustrate operation of the syringe and cartridge quick release mechanisms, in accordance with the present invention.
Figure 6A:
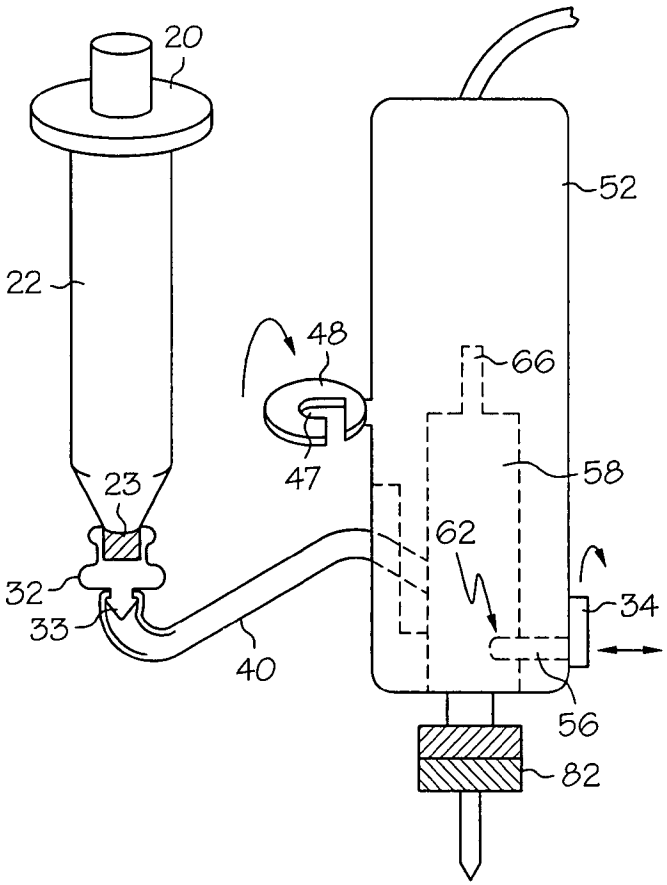

A cartridge release lever 34 is rotatably mounted to the housing 52 by bolt 38. When rotated, the cartridge release lever 34 engages an actuator pin 56, biased by spring 54 to remain in a released position. With reference to FIGS. 6A and 6B, the actuator pin 56 extends into the body of the housing 52 and engages an actuator pin capture 62 (see FIG. 2B) or elongated actuator pin capture (see FIG. 3B) formed in the cartridge body 60. In this manner the cartridge release lever is operable to remove/insert a cartridge 58 at the underside of the housing 52 as indicated by arrow 95 (see FIG. 1B).

A syringe 22 and feed tube 40 are releasibly coupled to a side wall of the housing, as shown. The syringe 22 includes a syringe holder 20, a syringe body 22, and a threaded outlet 23. An outlet adapter 32 mates with the thread 23 at an inlet end and with feed tube 40 at an outlet end. The feed tube 40 is preferably formed of a flexible material, a first end of which elastically deforms to fit over the outlet end of the syringe outlet adapter 32 to form a tight seal at neck region 33. The second end of the feed tube 40 inserts into a feed aperture 64 (see FIGS. 2B and 3B) formed in the cartridge body 60, or alternatively mates with a cartridge inlet port extending from the cartridge body 60.

With reference again to FIGS. 6A and 6B, the syringe 22 is likewise preferably configured to be readily separable from the pump housing 52, along with the cartridge 58. To accommodate this feature, a syringe quick-release arm 48 extends from a side wall of the pump housing 52, and includes a slot for snap-capturing the neck region 33 of the syringe outlet adapter 32. The quick release arm preferably elastically deforms to receive the neck 33, and to fix the syringe 22 in position during a dispensing operation. In this manner, the cartridge release lever 34 operates in conjunction with the syringe quick release arm to allow for easy removal and storage of the cartridge mechanism 58 and syringe 22 as a unit. This is especially helpful in situations where overnight refrigeration of the dispensing material is required, since the entire material pathway can be removed and stored as a unit, without the need for disassembly and cleaning of the individual components, as required by conventional pump configurations.

Figure 7A:
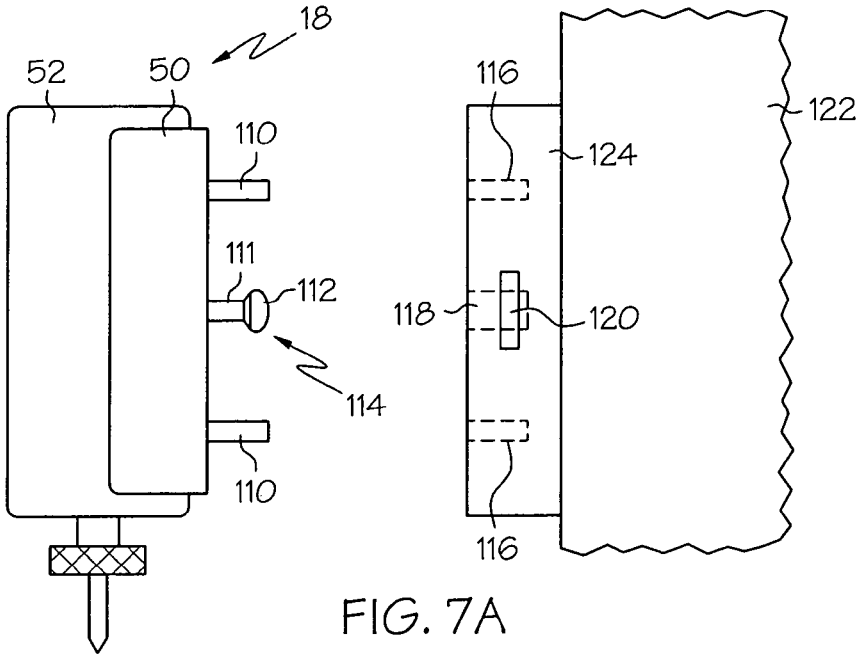
FIGS. 7A, 7B and 7C illustrate side, front, and top views respectively of a quick-release mounting plate, for mounting the pump to a pump dispensing frame, in accordance with the present invention.
Figure 7B:
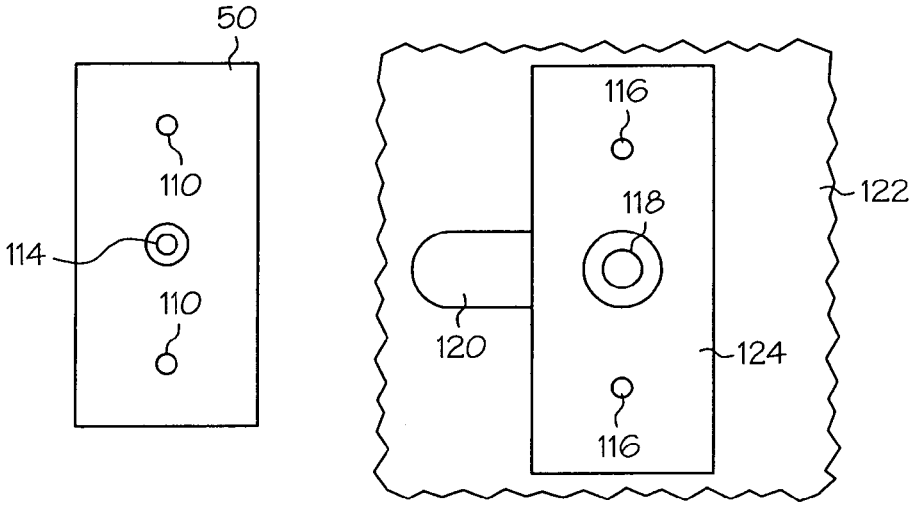
Figure 7C:
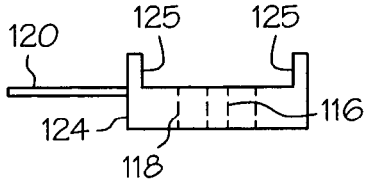

A release bracket 50 is mounted to a side wall of the housing 52. With reference to FIGS. 7A and 7B, the release bracket 50 includes first and second alignment pins 110 and a central lock pin 114, including a body 111 and retaining head 112, extending outwardly from its surface. A corresponding release bracket plate 124 is mounted to a dispensing frame 122, and includes alignment pin captures 116, a lock pin capture 118 and a spring-loaded lever 120. When operated, the lever, engages/disengages a clasp within the lock pin capture 118, that, in turn, clasps the retaining head 112 of the release bracket, when inserted and properly aligned with the plate 124. In this manner, the pump 18 can be readily attached/detached from the pump dispensing frame for maintenance and inspection. The alignment pins 110 and/or lock pin body 111 or retaining head 112 may optionally be keyed to ensure proper engagement. As shown in the top view of FIG. 7C, the release bracket plate 124 may optionally be configured with side walls 125 that communicate with the outer edge of the release bracket in order to provide a lateral keying function, thereby ensuring alignment accuracy and strength in cooperation with the alignment pins 110.

Figure 2A:
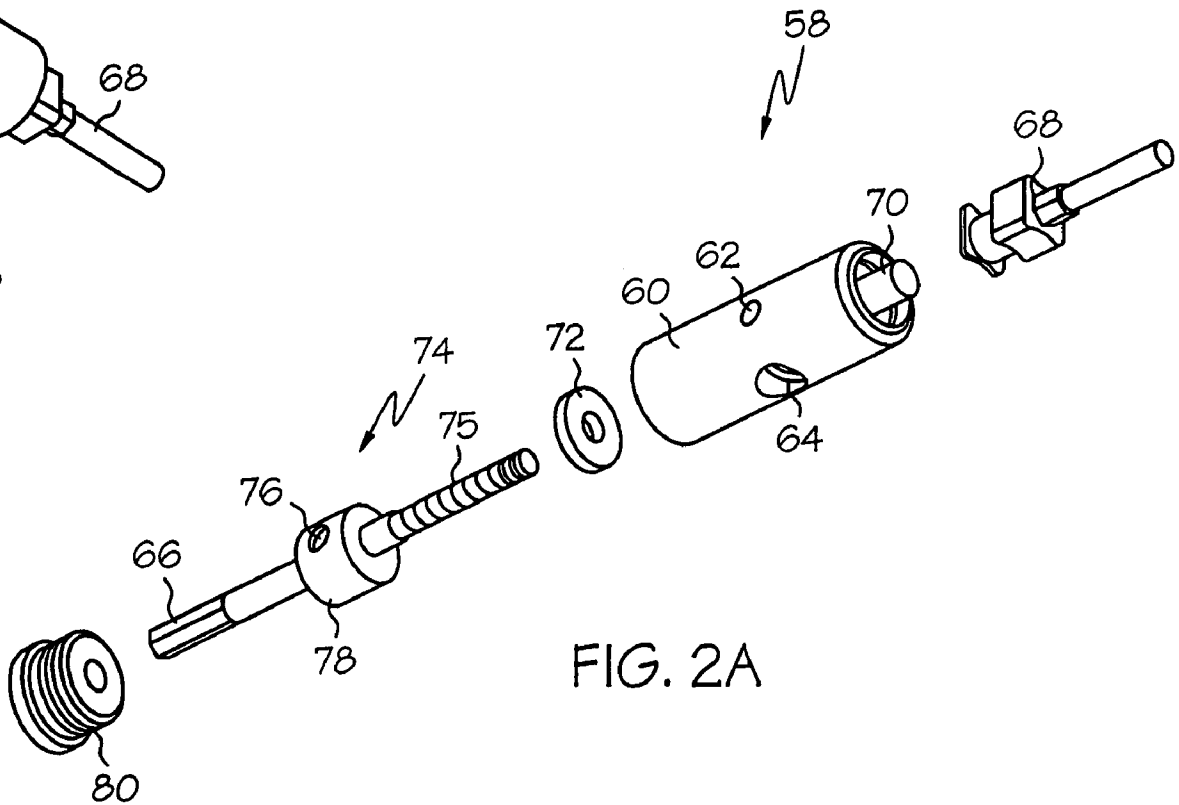
FIGS. 2A and 2B are an exploded perspective view and an assembled perspective view respectively of a fixed-z-type cartridge assembly in accordance with the present invention.
Figure 2B:
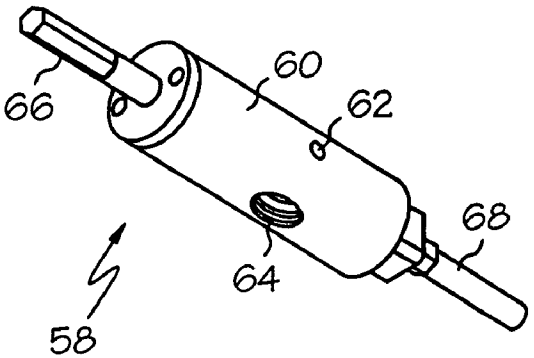

FIGS. 2A and 2B are an exploded perspective view and an assembled perspective view respectively of a fixed-z-type cartridge 58 assembly in accordance with the present invention. The cartridge assembly includes an elongated cartridge body 60, a first end of which is adapted to receive a fixed-z-type dispensing needle, for example Luer™-style needle 68. An opening at a second end of the cartridge receives an auger screw, or feed screw 74 having threads 75 at a first end, and having an indexed shaft 66 at an opposite end, adapted to register with the motor axle 41, or transmission axle. The auger screw 74 includes a collar 78, the height of which is adjustable by set screw 76. Washer 72 ensures a tight seal. A cap nut 80 contains the various cartridge components within the cartridge body 60. As explained above, an inlet port 64 is formed in the body 60 of the cartridge for receiving an end of the feed tube, for the delivery of material toward the feed screw threads 75. An actuator pin capture 62 engages the cartridge release pin 56, as described above. In the fixed-z embodiment of FIGS. 2A and 2B, the actuator pin capture 62 is the size of the release pin, to prevent longitudinal travel of the pump.

Figure 3A:
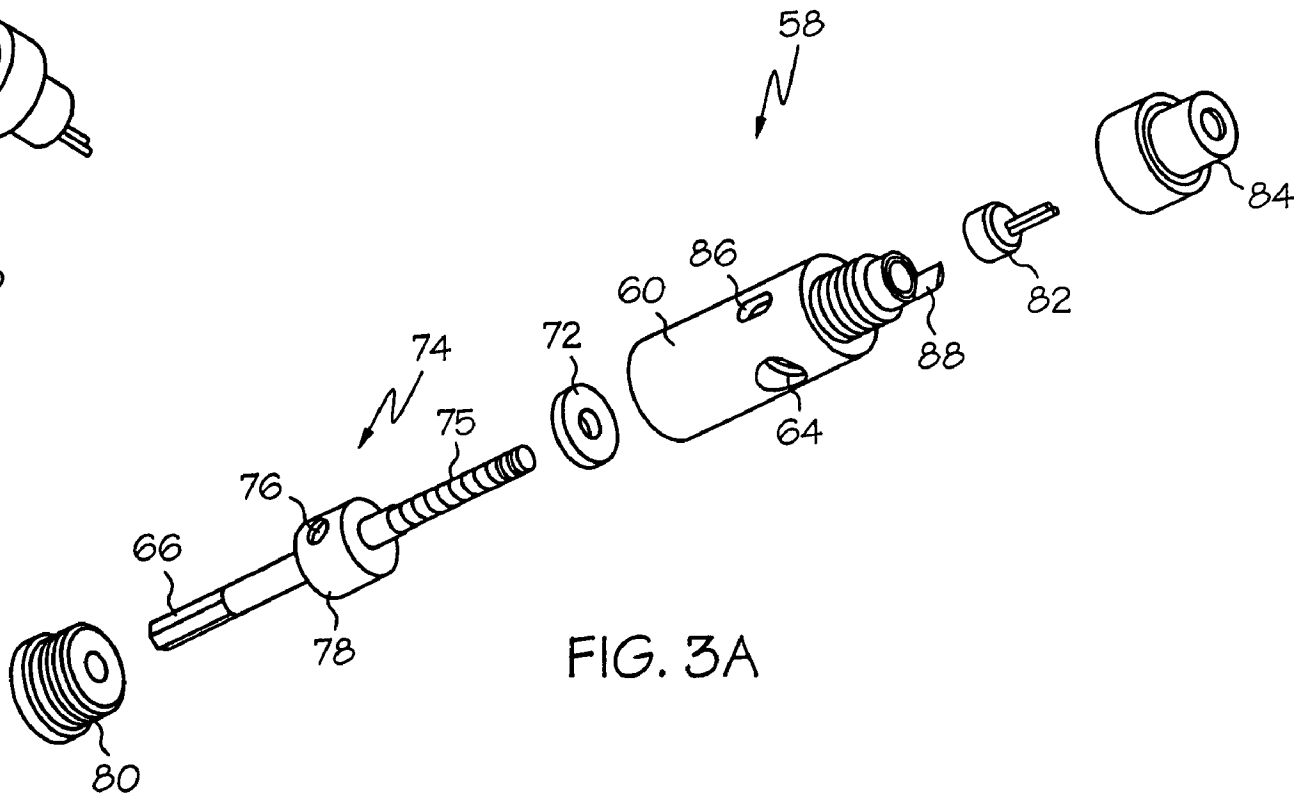
FIGS. 3A and 3B are an exploded perspective view and an assembled perspective view respectively of a floating-z-type cartridge assembly in accordance with the present invention
Figure 3B:
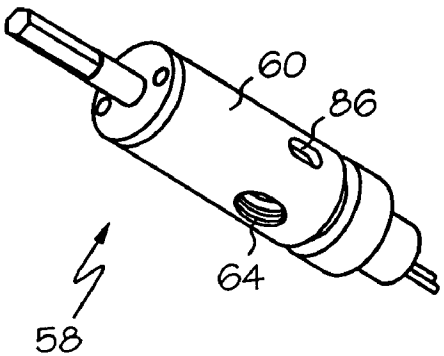

FIGS. 3A and 3B are an exploded perspective view and an assembled perspective view respectively of a floating-z-type cartridge 58 assembly in accordance with the present invention. In this embodiment, the feed screw mechanism is similar to that of FIGS. 2A and 2B; however, the cartridge is adapted for receiving a floating-z-type dispensing needle 82. The needle body 82 registers with locator 88 at the cartridge outlet, and is fixed in place by needle nut 84. For the floating-z-type cartridge assembly, an elongated actuator pin capture 86 is provided to allow for longitudinal travel of the cartridge 58 relative to the pump housing 52 during a dispensing operation.

Figure 4A:
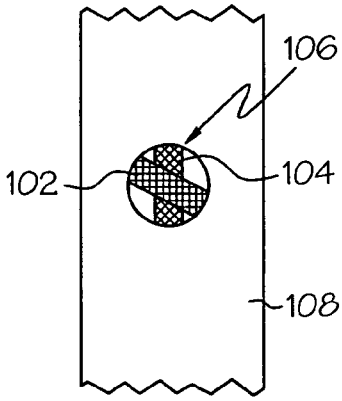
FIGS. 4A, 4B and 4C are side views of a cartridge opening illustrating the conventional embodiment having a small, circular opening, and first and second embodiments of the present invention having elongated openings respectively.

FIG. 4A of a inlet port for a conventional cartridge 108 embodiment having a small, circular port opening 106. In this embodiment, it can be seen that the pressurized material entering the port opening 106 periodically confronts a major diameter of the feed screw thread 102, which periodically inhibits flow of material into the feed screw cavity formed between the minor diameter portion 104 of the thread and the interior wall of the cartridge body 108. As much as ⅓ to ½ of the port opening can be periodically blocked by the major diameter of the feed screw thread 102 at any given time. The blockage fluctuates as a function of the rotational position of the feed screw which can cause inconsistency in material dispensing, especially at small tolerances, and can further alter pressure in the syringe system, as the blockage restricts material flow. The blockage further increases the likelihood of material stagnation and drying at the inlet port, in turn causing system contamination.

Figure 4B:
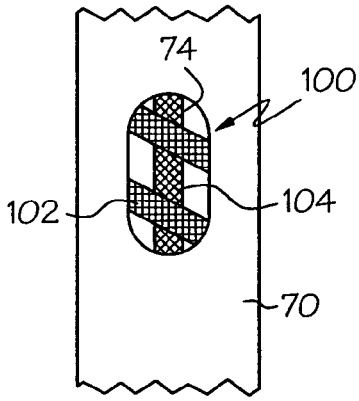
Figure 4C:
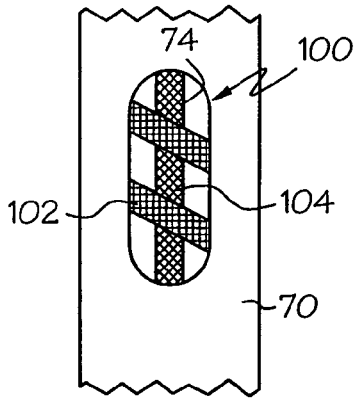

The present invention overcomes this limitation by providing an elongated cartridge inlet port. With reference to FIGS. 4B and 4C, the elongated inlet port 100 of the present invention is preferably elongated in a longitudinal direction, with respect to the longitudinal axis of the feed screw 74. In this manner, dispensing material is presented to a larger portion of the feed screw cavity formed between the minor diameter portion 104 and the inner wall of the cartridge 70. This configuration reduces pressure requirements for material delivery through the system, and enhances consistency in material flow, as the dependency on material flow rate as a function of the feed screw thread position is mitigated or eliminated. In general, a longer inlet port as shown in FIG. 3 is preferred, as compared to the relatively shorter inlet port 100 shown in FIG. 4B; however, the inlet port 100 should not be so long as to provide an opportunity for pooling of dormant material in the inlet port 100 prior to flow through the feed screw 74.

Figure 5A:
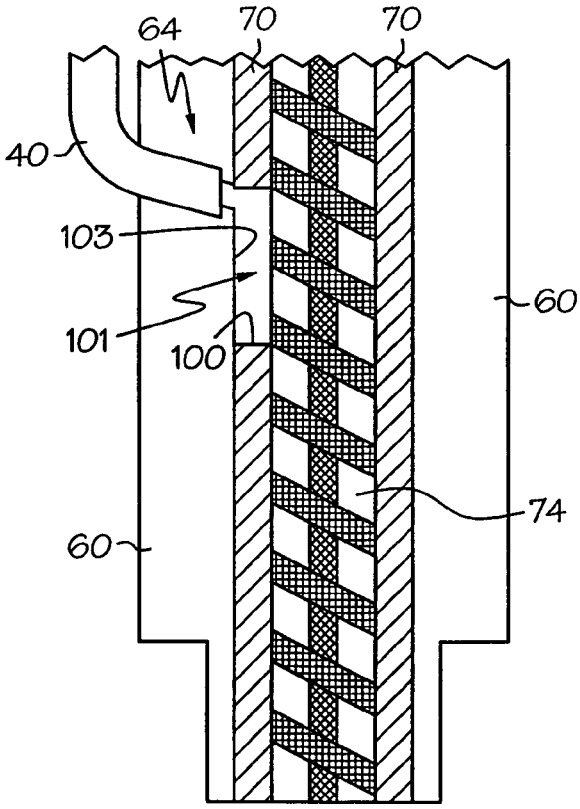
FIG. 5A is a cutaway side view of a cartridge feed mechanism employing a carbide liner including an elongated slot at the inlet to allow for increased capturing of input material at the feed screw inlet, in order to promote consistency in material flow at a reduced pressure, in accordance with the present invention.
Figure 5B:
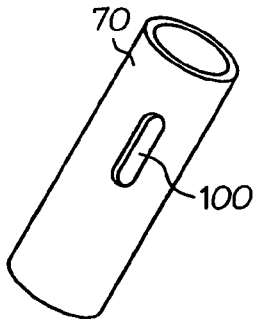
FIG. 5B. is a perspective view of the liner having an elongated slot, in accordance with the present invention.

FIG. 5A is a cutaway side view of a cartridge feed mechanism employing a carbide liner 70 including an elongated slot 100 at the inlet port to allow for increased capturing of input material at the feed screw inlet, in order to promote consistency in material flow at a reduced pressure, in accordance with the present invention. FIG. 5B. is a perspective view of the liner having an elongated slot, in accordance with the present invention.

In this embodiment, the elongated inlet port is provided by a slot 100 formed in a side wall of a cylindrical carbide liner 70 inserted in the cartridge body 60 about the feed screw 74. The cartridge inlet port 64 comprises a standard circular bore formed in the cartridge body 60, preferably at an acute angle relative to the feed screw 74, to allow gravity to assist in material flow. An elongated chamber, or pocket 101, is formed within the slot 100, between the feed screw 74 and the inner wall 103 of the cartridge body, in a region proximal to the inlet port 64. The elongated pocket 101 allows for dispensing fluid to migrate in a downward direction, and is captured by the feed screw threads over a larger surface area, conferring the various advantages outlined above.

Figure 8:
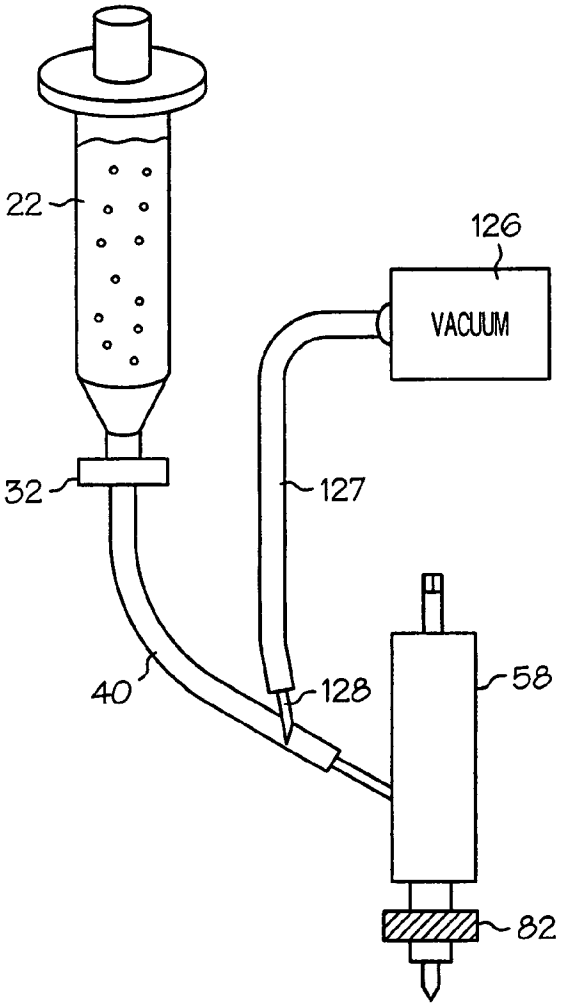
FIG. 8 is a illustration of an improved dispensing configuration employing a vacuum tube inserted into the material feed tube, in accordance with the present invention.

FIG. 8 is a illustration of an improved dispensing configuration employing a vacuum tube inserted into the material feed tube. In this embodiment, entrapped gas impurities, such as air microbubbles, are drawn from the material supply during a dispensing operation, thereby purging the system of entrapped air. A vacuum unit 126 draws a vacuum from the material supply tube 40, for example by a vacuum tube 127 with needle 128 inserted into the material feed tube 40, along the direction of material flow, as shown. In this manner, air is withdrawn from the dispensed material, leading to an improvement in dispensing consistency, especially at small tolerances.

Figure 9:
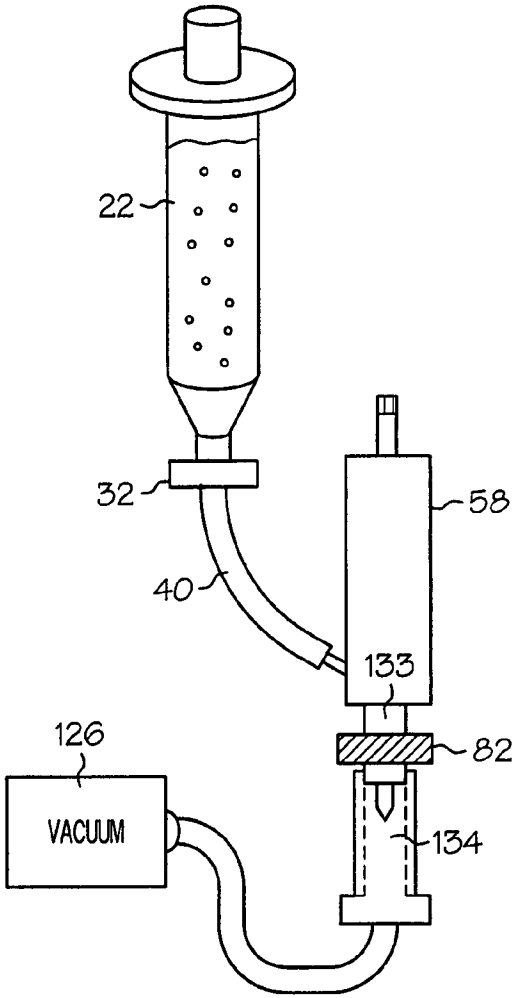
FIG. 9 is an illustration of an air purge configuration wherein a purge vacuum is applied to the needle assembly for initially purging the material flow of air pockets, to prime the system for dispensing, in accordance with the present invention.

FIG. 9 is an illustration of an air purge configuration wherein a purge vacuum is applied to the needle assembly for initially purging the material flow of air pockets, to prime the system for dispensing. In this process a first purge interface 134 is placed on the end of the feed tube, and a vacuum is drawn by vacuum unit 126, thereby purging the feed tube 40 of entrapped gas. A second purge interface 134 is then placed on the cartridge body outlet 133 while the feed screw is rotated slowly until material presents itself at the outlet 133. A vacuum is drawn by vacuum unit 126 to eliminate entrapped gas from the cartridge. A third purge interface 134 is then placed on the needle assembly 82 and a vacuum is drawn by vacuum unit 126 to eliminate entrapped air from the needle body. Entrapped air is thus substantially removed from the feed tube, auger screw and dispensing needle. Normal dispensing can commence following removal of the purge interface. Note that the first, second and third purge interfaces 126 may require different interface configurations for the different components undergoing purging.

Figure 10:
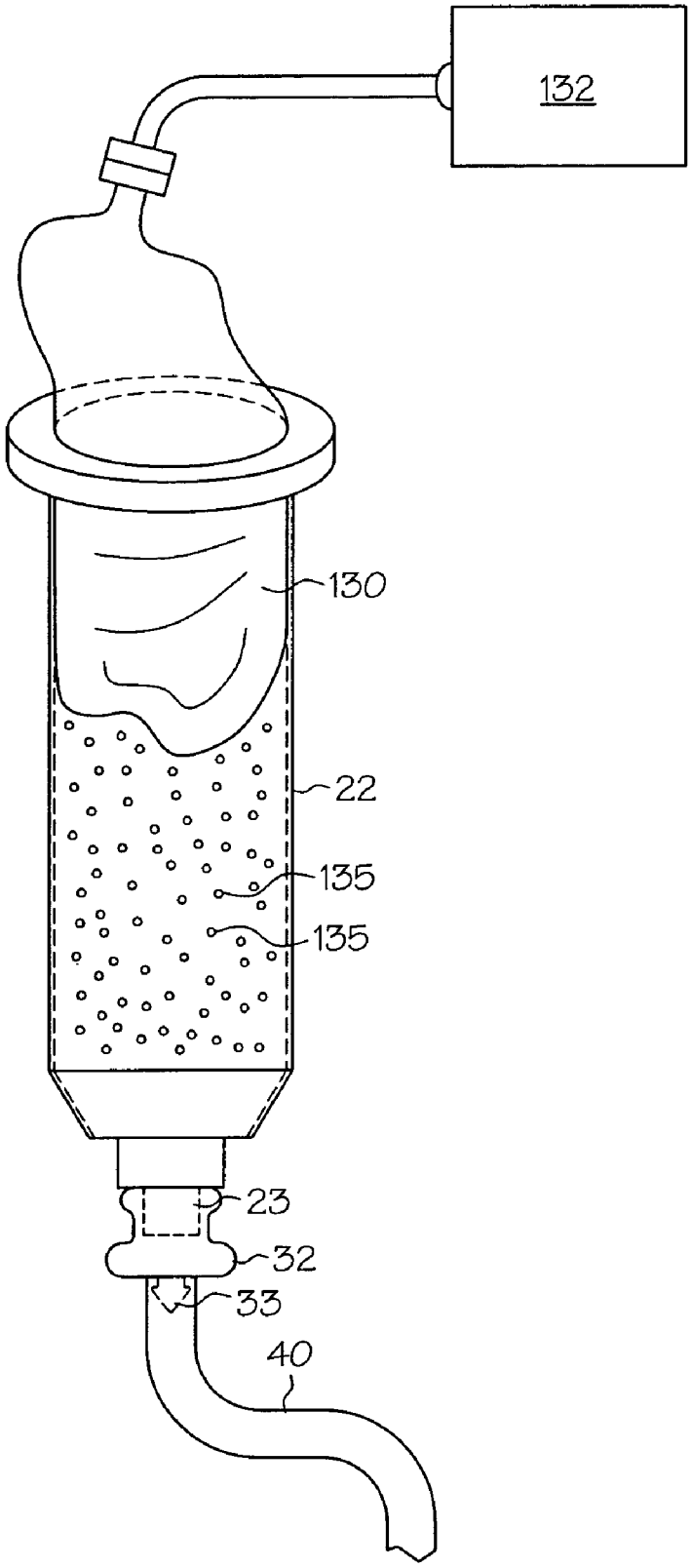
FIG. 10 is an illustration of a bellows configuration for application to the top of a material feed syringe, allowing for use of minimal pressure to drive material flow with mitigation or elimination of air migration into the material, in accordance with the present invention.

FIG. 10 is an illustration of a bellows configuration for application to the top of a material feed syringe, allowing for use of minimal pressure to drive material flow with mitigation or elimination of air migration into the material. In this configuration, a bellows means 130, for example comprising an air-tight, flexible material, is inserted at the piston end of, and replaces the piston of, a dispensing syringe 22. The bellows is pressurized by air pressure unit 132 from within and expands, thereby exerting pressure on the underlying material 135, forcing material flow through the outlet 32. In this manner, material can be driven with minimal pressure, and with minimal air migration into the material, as compared to plunger-style drivers. In a preferred embodiment, the bellows comprises a latex film applied about the lip of the syringe top. The flexible latex film serves to conform to the inner walls of the syringe during expansion, pushing the underlying material in a downward direction The syringe top is preferably vented to allow for expansion of the bellows.

In this manner a high-performance, lightweight pump configuration is provided. The pump is operable in both fixed-z and floating-z mode. Quick release mechanisms provide for storage of the syringe and cartridge as a single unit, without the need for component disassembly. The components themselves are relatively easy to clean and maintain. The elongated inlet port provides for enhanced dispensing consistency at a lower material pressure, while the various purging and priming techniques allow for removal of entrapped gases, further improving dispensing consistency.

The pump of the present invention is amenable to use with dispense tips configured in accordance with those described in U.S. patent application Ser. No. 09/491,615, filed Jan. 26, 2000, the contents of which are incorporated herein by reference, in their entirety.

Figure 11:
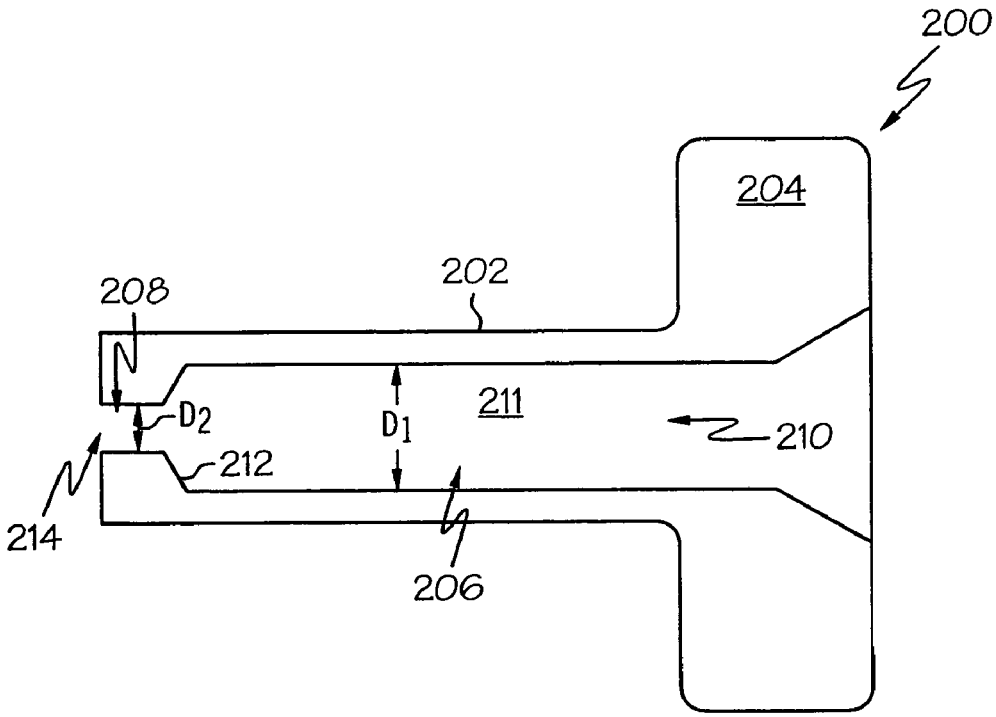
FIG. 11 is a cutaway side view of a dispense tip configuration in accordance with the present invention.

With reference to FIG. 11, such dispense tips 200 include a bore 210 formed in the neck 202 of the dispense tip 200, the bore 210 having an input end 211 of a first inner diameter D1, an output end 208 of a second inner diameter D2, and an inner taper 212 for transitioning the inner surface of the bore from the first inner diameter D1 to the second inner diameter D2. This dispense tip configuration allows for the delivery of fluid to the outlet 214 at a relatively low pressure as compared to conventional dispense tips having a single, narrow, inner diameter over the length of the neck. The wider diameter D1 along the majority of the neck 202 allows for delivery of fluid to the narrow diameter D2 opening at a relatively low pressure that is more desirable for volume control, while the relatively small opening 214 at the output end 208 allows for control over the volume of the dispensed fluid on the substrate.

In particular, the pump of the present invention is amenable to operation with dispense tips having a vented outlet face, as illustrated in FIGS. 12–15. Such vented dispense tips are beneficial in applications where a pattern of dispensed fluid, such as an "X", or a star-shaped pattern, is desired. Such applications include providing a fillet on a substrate for adhering a circuit die to the substrate. As the area of circuit dies continues to decrease, there is an increasing need for accurate dispensing of fillet patterns. An accurate and consistent dispense of the fillet pattern requires a predictable volume of dispensed fluid, as well as a precise pattern shape. For example, it is desirable that the legs of the X-pattern do not merge into one another due to migration of fluid between the vents.

Figure 12A:
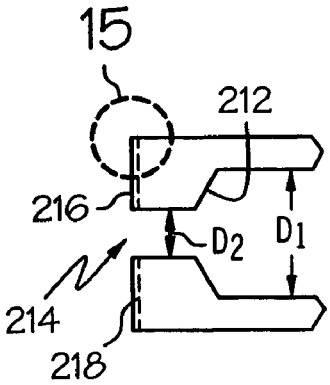
FIGS. 12A and 12B are side and end views respectively of the dispense tip of FIG. 11 having a vented outlet, in accordance with the present invention.
Figure 12B:
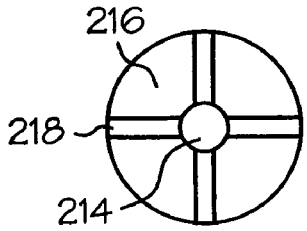

With reference to the cutaway side view of FIG. 12A and the output end view of FIG. 12B, in one embodiment, the vented dispense tip, configured in accordance with FIG. 11, includes vents 216 (in this example, four vents, but other numbers of vents are possible) that extend radially from the outlet 214 at the output end. The outer face 216 of the output end is flat and has a diameter equal to that of the outer diameter of the neck of the dispense tip.

Figure 13A:
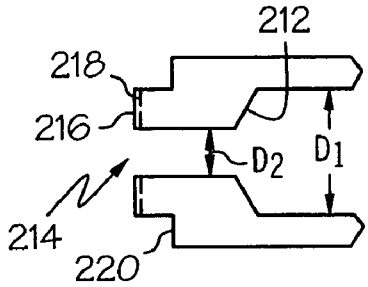
FIGS. 13A and 13B are side and end views respectively of the dispense tip of FIG. 11 having a vented and relieved outlet, in accordance with the present invention.
Figure 13B:
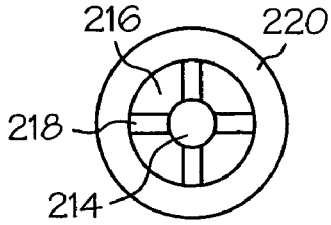

In the example of FIGS. 13A and 13B, the vented dispense tip, configured in accordance with FIG. 11, includes vents 218 that extend radially from the outlet 214 of the output end. The outer face 216 of the output end is flat and has a diameter that is less than that of the outer diameter of the neck of the dispense tip, as a circular relief 220 is formed about the outer face 216. The relief 220 is advantageous for those applications that require presentation of the dispensed pattern at a position close to an edge of a feature, or within a pocket on the substrate, since, owing to the relief 220, the center of the outlet 214 can be positioned closer to the edge of the feature for a deposit of fluid.

Figure 14A:
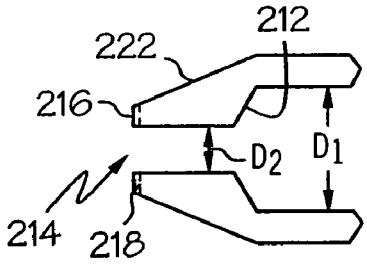
FIGS. 14A and 14B are side and end views respectively of the dispense tip of FIG. 11 having a vented and beveled outlet, in accordance with the present invention.
Figure 14B:
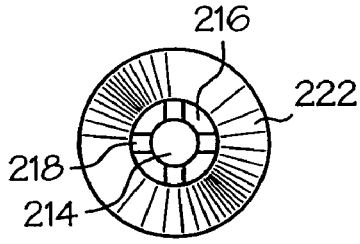

In the example of FIGS. 14A and 14B, the vented dispense tip, configured in accordance with FIG. 11, includes vents 218 that extend radially from the outlet 214 of the output end 208. The outer face 216 of the output end is flat and has a diameter that is less than that of the outer diameter of the neck of the dispense tip. A bevel 222 is formed about the outer face 216. In one example, the bevel can be formed according to the techniques described in U.S. patent application Ser. No. 09/491,615, filed Jan. 26, 2000, the contents of which are incorporated herein by reference above. The bevel reduces surface tension between the deposited fluid and the dispense tip, leading to more consistent and predictable deposit on the substrate. In an embodiment where the dispense tip bevel 222 is ground in a longitudinal direction, i.e. in a direction parallel to the longitudinal axis of the neck, the resulting tooling scars are longitudinal, and surface tension during a deposit is reduced even further, as described in the referenced patent application.

Figure 15:
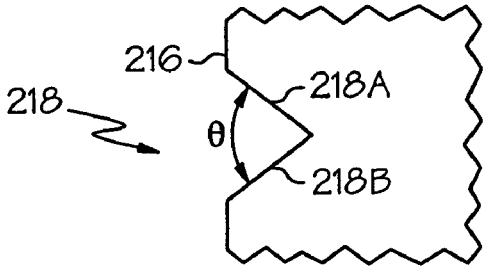
FIG. 15 is a closeup end view of an outlet vent, in accordance with the present invention.

With reference to the closeup view of FIG. 15, which illustrates an endwise view of a preferred embodiment of the dispense tip vent 218, the vent 218 preferably includes first and second angled faces 218A, 218B that are disposed at a vent angle θ with respect to each other. Deeper vent pockets tend to leave material on the dispense tip following a deposit, since the surface tension is increased owing to the increase surface area of the pocket. Rectangular, three-faced pockets having two side walls and a ceiling suffer from this limitation. A preferred embodiment of the present invention therefore incorporates vents that have two inner walls disposed at a vent angle θ to one another, as shown in FIG. 15. In one example, a 100 degree vent angle θ was found suitable for permitting adequate material flow through the vent, while minimizing surface tension at the outlet face 216. Other angles may be appropriate, for example between a range of 45 and 135 degrees; the selected angle depending on various characteristics of the deposit process, including flow rate, material type, volume, and other considerations.

In a preferred embodiment, the outlet face 216, including the vents 218 can be provided with a nutmeg-chrome finish, which provides a nickel/Teflon™ plating on the outer surface. Such a finish serves to further reduce surface tension at the outlet face.

In the closed-loop servo motor pump configuration of the present invention, auger rotation is controlled over its entire motion, from initiation to completion of a dispensing operation. In view of this, the control system managing the operation of the auger rotation is in complete control of the angular velocity and angular acceleration of the auger as it rotates. By managing the velocity, the dispensing of fluid can be controlled to an exceptionally high degree, including not only volume, but also rate. This, in turn, allows for predictability in fluid migration through the vents of the vented dispense tip during a deposit.

For example, assuming the rate of deposit is too slow, the dispensed material will tend to flow through the path of least resistance. If one of the vents has lower material flow resistance than the others, this can lead to an imbalanced dispense pattern, with more fluid deposited in the less-resistant leg. However, with control over the velocity of the auger, as in the configuration of the present invention, the velocity can be increased, causing the material to flow down all legs at a consistent rate, leading to more reliable deposit pattern profiles.

In an embodiment where the vents 218 are machined in the outlet face of the dispense tip, the vents are preferably ground or formed to have tooling lines in a direction parallel to the long axis of the vents, in order to reduce surface tension. The configuration of the vent depends on the width and volume of the desired dispense pattern.

Using the vented dispense tips illustrated above, a range of dispense patterns can be created. For example, assuming the auger is caused to rotate slightly, a small dot can be formed on the substrate, since fluid migration up the vents does not take place. With further rotation of the auger, an X pattern can be formed having legs of a length less than the length of the vents, since fluid migration takes place for a portion of the vents. With even further rotation of the auger, the X pattern can be formed with longer legs that equal the length of the vents. In this manner, a single, vented dispense tip, in combination with the closed loop servo motor dispense pump of the present invention can provide a range of dispensing profiles while reducing the number of dispense tips required.

The outlet face 216 effectively serves as a foot for the dispense tip. In this manner, the vented dispense tip of the present invention is suitable for floating-z applications, wherein the outlet face comes in contact with the substrate during a dispensing operation. Alternatively, the vented dispense tip of the present invention is also applicable to fixed-z configurations.

While this invention has been particularly shown and described with reference to preferred embodiments thereof, it will be understood by those skilled in the art that various changes in form and detail may be made herein without departing from the spirit and scope of the invention as defined by the appended claims.

For example, the enhanced control over material flow offered by the various configurations of the present invention make the pump system of the present invention especially amenable to use with dispense needles having a flat dispensing surface with a cross pattern formed in the dispensing surface for dispensing cross patterns for providing a fillets for boding a dye to a substrate. Particularly, since the closed-loop servo motor pump of the present invention offers control over both position and velocity of the feed screw, the delivery of fluid through the needle to the cross pattern can be controlled to a level of precision previously unattainable. Cross-pattern-style fillets can be achieved at a level of accuracy orders of magnitude beyond those currently achieved.

I claim:

1. A cartridge adapted for coupling to a fluid pump comprising:

a body having a bore;

a fluid inlet at a proximal end of the bore;

a fluid outlet at a distal end of the bore;

a feed screw for delivering fluid from the fluid inlet to the fluid outlet, the feed screw having a longitudinal axis, the fluid inlet being elongated in a direction along the longitudinal axis of the feed screw; and a dispense tip at the fluid outlet having a longitudinal fluid path, the dispense tip having outlet vents comprising grooves in an outer surface of an output end of the dispense tip, the outlet vents extending radially from the fluid path.

2. The cartridge of claim 1 wherein the outlet vents each comprise a V-groove having first and second inner surfaces.

3. The cartridge of claim 2 wherein the first and second inner surfaces of the V-groove intersect at an angle ranging between 45 degrees and 135 degrees.

4. The cartridge of claim 1 wherein the outlet vents are treated by a finishing process that reduces surface tension.

5. The cartridge of claim 4, wherein the outlet vents are machined to form tooling lines in a direction parallel to a long axis of the vents that reduces the surface tension.

6. The cartridge of claim 1 wherein the output end of the dispense tip includes a relieved outer surface.

7. The cartridge of claim 1 wherein the output end of the dispense tip includes a beveled outer surface.

8. The cartridge of claim 1 wherein the fluid inlet includes an elongated slot formed in the liner for receiving material provided at the fluid inlet, and for providing a pooling region for material to be distributed to the feed screw.

9. The cartridge of claim 1 further comprising a closed-loop servo-motor coupled to the feed screw for positioning the feed screw.

10. A fluid dispensing pump comprising:

a feed screw having a helical cavity defined between a major diameter and a minor diameter of a thread of the feed screw;

a cartridge body having a cavity in communication with the feed screw for introduction of dispensing fluids into the helical cavity;

a closed-loop servo-motor having indexed rotational positions for controlling a rotational position of the feed screw during a dispensing operation; and a dispense tip at a fluid outlet of the helical cavity having a longitudinal fluid path, the dispense tip having outlet vents comprising grooves in an outer surface of an output end of the dispense tip, the outlet vents extending radially from the fluid path.

11. The fluid dispensing pump of claim 10 wherein the outlet vents each comprise a V-groove having first and second inner surfaces.

12. The fluid dispensing pump of claim 11 wherein the first and second inner surfaces of the V-groove intersect at an angle ranging between 45 degrees and 135 degrees.

13. The fluid dispensing pump of claim 10 wherein the outlet vents are treated by a finishing process that reduces surface tension.

14. The fluid dispensing pump of claim 10 wherein the output end of the dispense tip includes a relieved outer surface.

15. The fluid dispensing pump of claim 10 wherein the output end of the dispense tip includes a beveled outer surface.

16. The fluid dispensing pump of claim 10 wherein the cavity is positioned along a side portion of the feed screw.

17. The fluid dispensing pump of claim 10 wherein the cavity is elongated in a direction substantially along a longitudinal axis of the feed screw.

18. The fluid dispensing pump of claim 10 wherein the closed-loop servo-motor includes a positional encoder.

19. A fluid dispensing pump comprising:

a cartridge adapted for coupling to a fluid pump, the cartridge comprising:

a body having a bore;

a fluid inlet at a proximal end of the bore;

a fluid outlet at a distal end of the bore;

a feed screw having a helical cavity for delivering fluid from the fluid inlet to the fluid outlet; and a dispense tip at the fluid outlet having a longitudinal fluid path, the dispense tip having outlet vents comprising grooves in an outer surface of an output end of the dispense tip, the outlet vents extending radially from the fluid path; and a closed-loop servo-motor that controls a rotational position and rotational velocity of the feed screw during a dispensing operation to in turn dispense the fluid at the output end of the dispense tip at a controlled rate and volume.

20. The fluid dispensing pump of claim 19 wherein the outlet vents each comprise a V-groove having first and second inner surfaces.

21. The fluid dispensing pump of claim 20 wherein the first and second inner surfaces of the V-groove intersect at an angle ranging between 45 degrees and 135 degrees.

22. The fluid dispensing pump of claim 19 wherein the outlet vents are treated by a finishing process that reduces surface tension.

23. The fluid dispensing pump of claim 19 wherein the output end of the dispense tip includes a relieved outer surface.

24. The fluid dispensing pump of claim 19 wherein the output end of the dispense tip includes a beveled outer surface.

25. The fluid dispensing pump of claim 24, wherein the beveled outer surface is ground substantially along the longitudinal axis of the neck such that any tooling marks resulting therefrom are substantially aligned with the longitudinal axis of the neck.

26. The fluid dispensing pump of claim 19 wherein the fluid inlet includes an elongated slot formed in the liner for receiving material provided at the fluid inlet, and for providing a pooling region for material to be distributed to the feed screw.

27. The fluid dispensing pump of claim 26 wherein the elongated slot is elongated in a direction substantially along a longitudinal axis of the feed screw.

28. The fluid dispensing pump of claim 19 wherein the closed-loop servo-motor includes a positional encoder.

29. The fluid dispensing pump of claim 19, wherein the closed-loop servo-motor controls the feed screw to dispense the fluid at the output end of the dispense tip in a dispense pattern having a predetermined width and volume.

30. The fluid dispensing pump of claim 29, wherein when the feed screw is in a first rotational position, the fluid is dispensed in a first dispense pattern, and when the feed screw is further rotated to a second rotational position from the first rotational position, the fluid is dispensed in a second dispense pattern.

31. The fluid dispensing pump of claim 30, wherein the first dispense pattern is a dot pattern.

32. The fluid dispensing pump of claim 30, wherein the second dispense pattern is a pattern having a plurality of legs that extend from a central position.

33. The fluid dispensing pump of claim 19, wherein the closed-loop servo-motor further controls rotational acceleration of the feed screw.

34. The fluid dispensing pump of claim 19, wherein the outlet vents are ground substantially along their longitudinal axes such that any tooling marks resulting therefrom are substantially aligned with the longitudinal axes of the outlet vents.

* * * * *

UNITED STATES PATENT AND TRADEMARK OFFICE

CERTIFICATE OF CORRECTION

PATENT NO. : 7,178,745 B1
APPLICATION NO. : 11/082539
DATED : February 20, 2007
INVENTOR(S) : Jeffrey P. Fugere It is certified that error appears in the above-identified patent and that said Letters Patent is hereby corrected as shown below:

Title Page #56
In the References Cited Section of the Issued Patent, delete "2,933,256" and insert --2,933,259--

Signed and Sealed this

Nineteenth Day of June, 2007

JON W. DUDAS
*Director of the United States Patent and Trademark Office*